US009339129B1

(12) United States Patent
Taylor

(10) Patent No.: US 9,339,129 B1
(45) Date of Patent: May 17, 2016

(54) PORTABLE EXHIBIT DISPLAY WITH MAGNETIC ACCESSORY MOUNTS

(71) Applicant: Vomela Specialty Company, St. Paul, MN (US)

(72) Inventor: Kelly Taylor, Syracuse, UT (US)

(73) Assignee: Vomela Specialty Company, St. Paul, MN (US)

( * ) Notice: Subject to any disclaimer, the term of this patent is extended or adjusted under 35 U.S.C. 154(b) by 0 days.

(21) Appl. No.: 14/656,960

(22) Filed: Mar. 13, 2015

Related U.S. Application Data

(60) Provisional application No. 61/953,254, filed on Mar. 14, 2014.

(51) Int. Cl.
*A47B 43/00* (2006.01)
*A47F 5/10* (2006.01)
*A47F 5/00* (2006.01)

(52) U.S. Cl.
CPC ..... *A47F 5/10* (2013.01); *A47F 5/0043* (2013.01)

(58) Field of Classification Search
CPC ..... A47F 5/10; A47F 5/0043; G09F 13/04; G09F 15/00; G09F 15/0068; G09F 15/0012; E04B 1/19; E04B 1/3441; E04B 2001/1927; E04B 2001/199; E04B 2001/1984; A47G 1/17; E04H 15/64
USPC ..... 211/186
See application file for complete search history.

(56) References Cited

U.S. PATENT DOCUMENTS

| | | | | | |
|---|---|---|---|---|---|
| 3,017,036 | A * | 1/1962 | Albert et al. | 211/87.01 |
| 4,058,357 | A * | 11/1977 | Wallace | 439/40 |
| 4,586,616 | A * | 5/1986 | Cooper et al. | 211/88.04 |
| 4,658,560 | A * | 4/1987 | Beaulieu | 52/646 |
| 5,417,397 | A * | 5/1995 | Harnett | 248/309.4 |
| 5,746,329 | A * | 5/1998 | Rondeau | 211/123 |
| 6,085,916 | A * | 7/2000 | Kovacevic et al. | 211/86.01 |
| 6,658,697 | B2 * | 12/2003 | Liao | 16/82 |
| 6,712,229 | B2 | 3/2004 | Fritsche | |
| 7,024,834 | B2 | 4/2006 | Gimpel | |
| 7,744,328 | B2 | 6/2010 | Jung et al. | |
| 8,056,572 | B2 * | 11/2011 | Livacich et al. | 135/98 |
| 8,065,847 | B2 | 11/2011 | Gimpel | |
| 8,205,846 | B2 * | 6/2012 | Glunk | 248/309.4 |
| 8,312,653 | B2 | 11/2012 | Fritsche | |
| 8,458,937 | B2 | 6/2013 | Fritsche | |
| 8,750,079 | B2 | 6/2014 | Lagorgette | |
| 8,807,193 | B2 | 8/2014 | Zarelius | |
| 8,879,149 | B2 | 11/2014 | Kunze | |
| 8,943,723 | B2 | 2/2015 | Valentine et al. | |
| 2005/0236347 | A1 | 10/2005 | Cole | |
| 2010/0236116 | A1 * | 9/2010 | Gimpel et al. | 40/606.03 |
| 2012/0044031 | A1 | 2/2012 | Ninomiya | |
| 2012/0119629 | A1 | 5/2012 | Nelson | |
| 2013/0329287 | A1 | 12/2013 | Zarelius | |
| 2015/0014260 | A1 | 1/2015 | Lynch | |

* cited by examiner

*Primary Examiner* — Korie H Chan
(74) *Attorney, Agent, or Firm* — Haugen Law Firm PLLP

(57) ABSTRACT

A portable exhibit display includes a framework and a fabric covering for tensioned securement to the framework. Three dimensional attachments may be secured to the framework with the covering sandwiched between the framework and the three dimensional accessory. The framework and three dimensional accessory incorporates a plurality of magnet fittings to attract and secure at attachment points and regions the three dimensional object to the framework.

11 Claims, 3 Drawing Sheets

PORTABLE EXHIBIT DISPLAY WITH MAGNETIC ACCESSORY MOUNTS

CROSS-REFERENCE TO RELATED APPLICATIONS

This application claims the filing benefit and priority of U.S. Provisional Patent Application Ser. No. 61/953,254, filed on Mar. 14, 2014 and entitled "Portable Exhibit Display with Magnetic Accessory Mounts", the contents of which are being incorporated herein by reference in their entirety.

FEDERAL SPONSORSHIP

Not Applicable

JOINT RESEARCH AGREEMENT

Not Applicable

TECHNICAL FIELD

The present invention relates to portable exhibit displays generally, and more particularly to a tensioned fabric exhibit display having a magnetic attachment array that allows for securing and removing three dimensional accessories to the tensioned fabric display without modifying the fabric display.

BACKGROUND

In the past exhibit displays have been utilized at meetings, trade shows, and other events. Prior exhibit displays have attempted to provide structures that may be easily transported and erected for the intended temporary usage. Such portable exhibit displays may employ a network of interconnected frame members to form a support frame, and a fabric, modular covering, canvas, or banner connected to the support frame.

Incorporating accessories such as shelving, mounting brackets, and other items into the typically flat exhibit displays, may be desirable to highlight specific products, influence a particular audience, or for many other creative and aesthetic reasons. However, securing such accessories to conventional exhibit displays, has required additional framing, modified coverings or banners, and the use of mechanical fasteners that penetrate through the covering material to be anchored to the support frame. Attaching accessories with additional framework and mechanical fasteners is time consuming and can aesthetically or structurally damage the fabric covering, which often times comprises expensive graphical materials. Also, puncturing the banners or other covering material with mechanical fasteners may prevent the repeated use of the covering materials, resulting in a significant added expense for portable exhibit displays.

Consequently, there is a need for a portable exhibit display that facilitates rapid attachment and detachment of accessories without damage or modification to a banner or other covering material. There is further a need to provide an exhibit display that provides flexibility in the orientation and placement of the three dimensional accessories onto the exhibit display, so as to custom-arrange promotional and/or instructional materials and exhibits.

SUMMARY

Embodiments according to aspects of the invention provide an exhibit display framework that allows for simple and efficient connection and removal of three dimensional attachments to a portable exhibit display. The preferred attachments may enhance the aesthetics and/or functionality of the display. Example accessories include shelving units, brackets, graphical displays, side walls, accent lighting, and the like. The apparatus of the present invention includes a coupling framework that secures the accessories to the portable exhibit display without the need for separate mechanical fasteners.

In accordance with aspects of the invention, an embodiment of the exhibit display includes a framework, a framework covering, and removable three dimensional accessories coupled to the framework. The framework has a base and a plurality of interconnected frame members that form the framework. At least two of the frame members has a plurality of receptacles formed in the frame members and the receptacles have magnetized fittings contained within the receptacles such that an outer surface of the magnetized fittings aligns flush with an outer side of the frame members. The magnetized fittings define magnetic attachment regions along the framework. The three dimensional accessory has an attachment point consisting of at least one of a metallic plate and second magnetized fittings. The attachment point is arranged on the accessory to align with the attachment region of the framework. The magnetized fittings have a sufficient magnetization to couple and retain the three dimensional accessory to the framework with the covering sandwiched between the accessory and framework.

In accordance with aspects of the invention, an embodiment of the portable exhibit display of the present invention includes a frame having a plurality of interconnecting frame members. The frame members have an outer concentric tubular side wall that defines an internal chamber. The frame members further include an array of receptacles formed in the tubular side walls that create and opening extending into the chamber. The portable exhibit display further includes a fabric covering for tensioned securement to the frame, and a plurality of fittings secured in respective receptacles. The fittings have first and second ends along a fitting axis, and include a cavity that opens to the first end. The fittings are positioned so as to be substantially contained at a respective chamber. The display of the present invention further includes a plurality of first magnets, each secured in the cavity of a respective fitting so as to be substantially coextensive with the first end of the fitting. The plurality of first magnets define magnetic attachment regions of a magnetic attachment array. An accessory having a rear surface including an attachment point with at least one of a metallic plate and a second magnet may be secured to the fabric covering in proximity to a respective magnetic attachment region through a magnetic attraction force to the first magnets at a respective magnetic attachment region.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
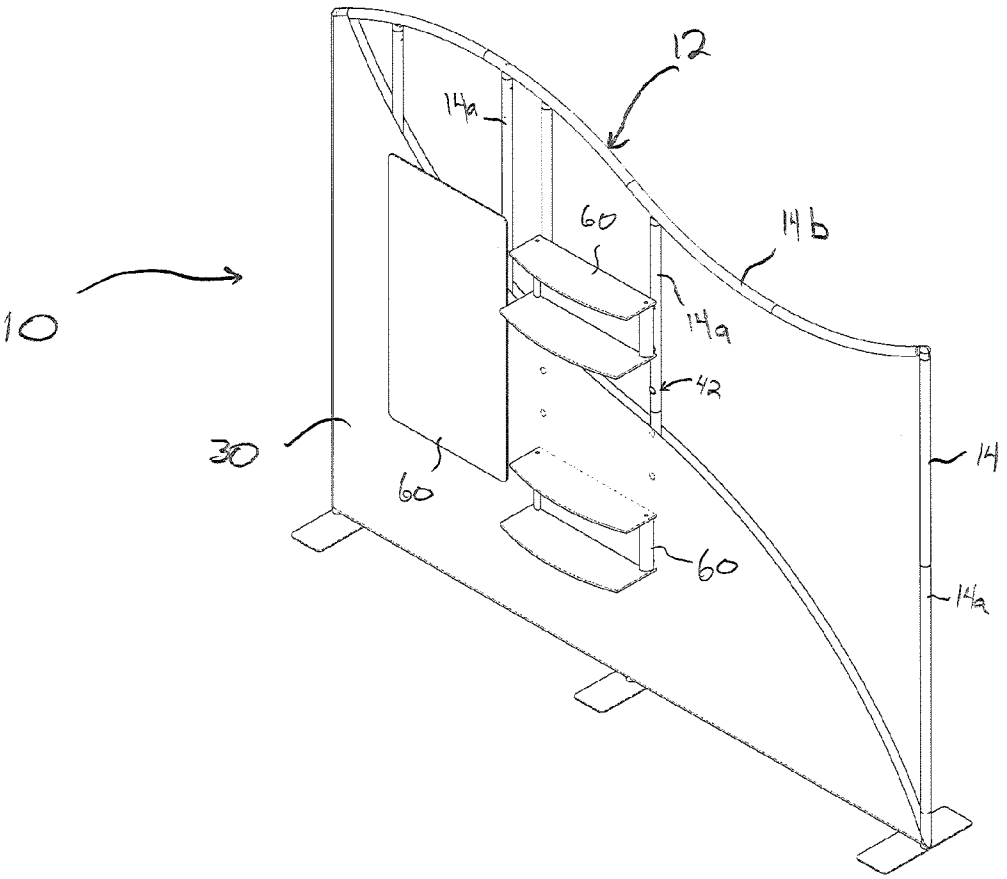
FIG. 1 is a schematic partial cut-away view of a portable exhibit display of the present invention.
Figure 2B:
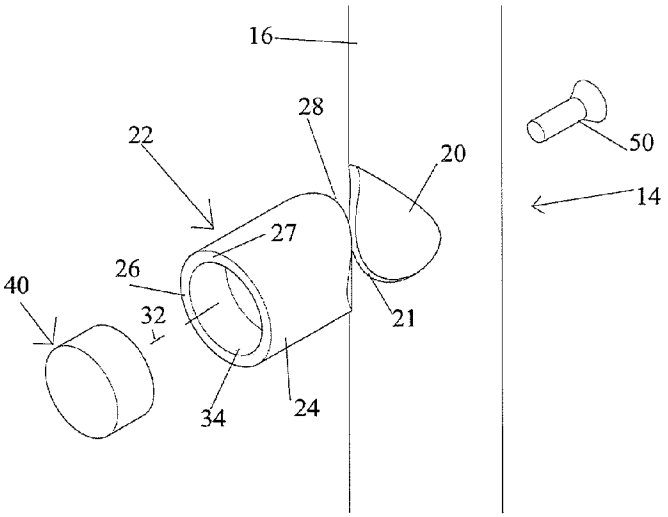
FIG. 2B is an exploded perspective view of the portion of the portable exhibit display illustrated in FIG. 2A.
Figure 2D:
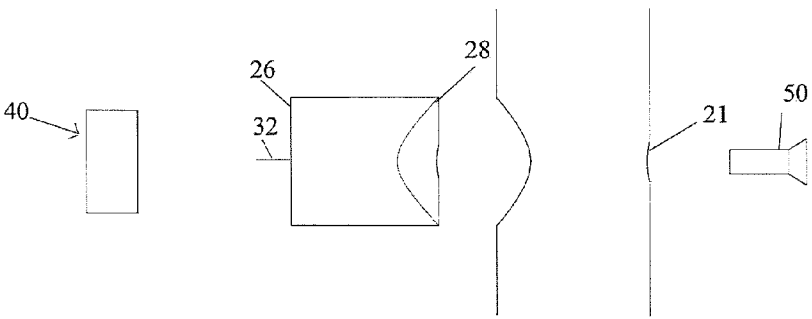
FIG. 2D is an exploded side elevational view of FIG. 2B.
Figure 2A:
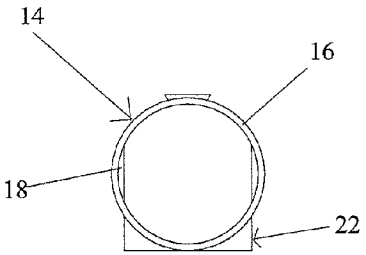
FIG. 2A is a top view of a portion of the portable exhibit display.
Figure 2C:
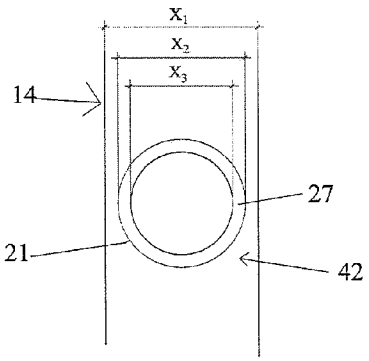
FIG. 2C is a front elevation view of the portion of the portable exhibit display illustrated in FIG. 2A.
Figure 3B:
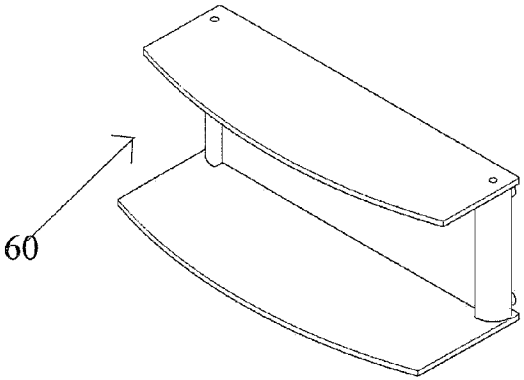
FIG. 3B is an exploded perspective view of the accessory illustrated in FIG. 3A.
Figure 3D:
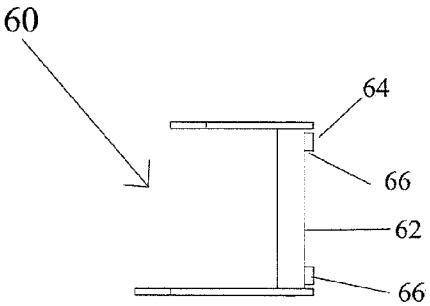
FIG. 3D is an side elevation view the accessory illustrated in of FIG. 3A.
Figure 3A:
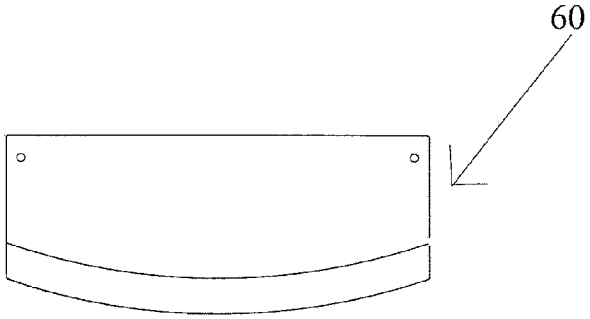
FIG. 3A is a top view of an accessory portion of the portable exhibit display.
Figure 3C:
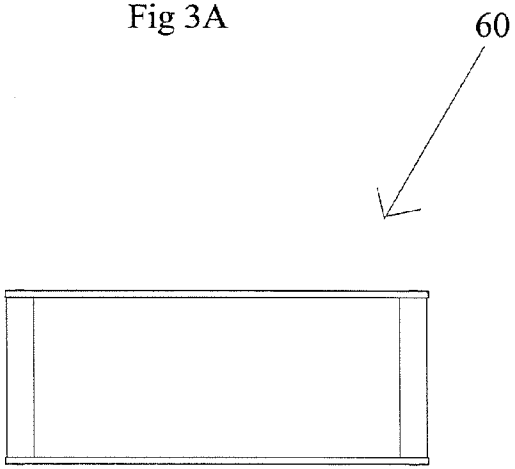
FIG. 3C is a front elevation view of the accessory illustrated in FIG. 3A.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

Unless otherwise apparent or stated, directional references, such as "upper", "lower", "inner", "outer", "top", "bottom", "vertical", "horizontal", and the like are intended to be relative to the orientation of a particular embodiment of the invention as shown in the figures. In addition, a given reference numeral indicates the same or similar structure when it appears in different figures, and like reference numerals identify similar structural elements and/or features of the subject invention.

A portable exhibit display 10 of the present invention includes a frame 12 having a plurality of interconnecting frame members 14. In the illustrated embodiments, frame members 14 include upright members 14*a* and cross members 14*b* connecting between and/or among upright members 14*a*.

As shown in FIGS. 2A-2D, frame members 14 are constructed of hollow tubular material. The frame members include a tubular side wall 16 and the hollow portion defines a chamber 18. While a variety of configurations for frame members 14 are contemplated by the present invention, substantially circular or square cross-section hollow tubular frame members 14 are most commonly utilized.

The portable exhibit display 10 illustrated in FIG. 1 includes a fabric covering 30 that is shown partially cut away to reveal frame 12. Fabric covering 30 may include a perimeter hem and pockets so as to drape over frame 12 in a manner that the frame members or framework 14 supports the fabric from within a pocket formed by the fabric. Alternative arrangements are also known in the art for securing a covering fabric to a display frame, including hook and loop-type fastening mechanisms, zippers, tie strings, and the like. Fabric covering 30 may preferably be tensioned to frame 12 to create a smooth display surface appearance. Fabric covering 30 may be provided in one or more pieces or units for securement to frame 12 as desired. Also, the fabric covering 30 may be formed from one or more of a variety of materials suitable for the intended use. Suitable fabrics include woven, non-woven, and laminated constructions of natural or artificial materials, as well as combinations thereof. A particular example is a polymer-based material suitable as a substrate for graphical printing processes. Examples of such polymer substrate materials include heavy-knit cloths suitable for dye sublimation and direct-type printing processes. Fabric covering 30 may further exhibit a suitable degree of flexibility for the intended portable exhibit display.

It is also contemplated by the present invention that frame 12 may be covered for aesthetic purposes with distinct panels that may or may not include a fabric covering 30. Such display panels are well known in the art, and may be affixed to frame 12 through known securement means.

Frame members 14 of frame 12 may typically be fabricated from a lightweight metal such as aluminum or titanium, but may be otherwise manufactured from any suitable material or combination of materials, including a fiberglass composite. Frame members 14 preferably include an array of receptacles 20 in the sidewalls. The receptacles 20 are formed in the frame members 14 and may extend into the hollow chambers 18. In the illustrated embodiment, receptacles 20 may be openings that are sized to receive and frictionally engage a fitting 22 (see for example FIG. 2B). Accordingly, the opening of the receptacle 20 may have a diameter that is substantially equivalent to an outer diameter or exterior size of fitting 22. In this embodiment the fitting 22 is capable of being inserted into receptacle 20 in a manner, such as a press fit, so that an opening wall 21 defining receptacle 20 frictionally engages outer surface 24 of fitting 22 to securely retain fitting 22. In other embodiments, however, opening wall 21 may be enlarged so that the fitting 22 is not frictionally retained within the receptacle 20. Instead an adhesive, screws, magnetic attraction or other known attachment mechanism is utilized to provide a source of retention force for retaining fitting 22 at receptacle 20.

In an embodiment of the invention, magnetic fitting 22 includes first and second ends 26, 28 along a fitting axis 32, and a cavity 34 that opens to at least first end 26. When installed at receptacle 20, fitting 22 may be substantially contained in chamber 18.

Fitting 22 may be fabricated from any suitable material, and is configured for installation into receptacle 20 of frame member 14. In some embodiments, fitting 22 may be fabricated from a polymeric material, such as polyoxymethylene (POM) available from DuPont under the DELRIN® trade name.

An example set of dimensional parameters for the present invention includes frame members 14 having a substantially circular cross-section with an outer diameter X1 of about 1.5 in. Outer diameter X2 of a substantially circular cross-section fitting 22 may be about 1.25 in., and substantially equivalent to the opening diameter of receptacle 20. In this arrangement, first end wall 27 may have a width of 0.125 in., such that diameter X3 of cavity 34 may be about 1 in. A depth dimension of cavity 34 is preferably appropriate to receive a first magnet 40 therein, and may be, for example, at least 0.5 in. Other dimensional arrangements for the components of the present invention are contemplated as being within the grasp of those having ordinary skill in the art.

First magnets 40 may be secured in respective cavities 34 of fittings 22 positioned at frame members 14 of frame 12. First magnets 40 may be received in respective cavities 34 so as to be substantially coextensive with first end wall 27. The plurality of first magnets 40 define magnetic attachment regions 42 of a magnetic attachment array about frame 12. First magnets 40 may be rare earth magnets configured for retention in respective cavities 34 of fittings 22. Example first magnets 40 are available from Applied Magnets under the trade name Neodymium magnets.

In an embodiment of the invention, first magnet 40 may be secured in respective cavities 34 by an attachment, such as adhesives, fasteners, or the like. Moreover, fitting 22 may be secured in chamber 18 with a screw 50 that extends through an aperture 21 in frame member 14, so as to threadably engage with fitting 22. Alternatively, the first magnet 40 may be sized and shaped to fit and engage directly into the receptacle 20 and in affect become the magnetic fitting 22. Other mechanisms for additionally or solely securing fitting 22 to frame member 14 are known in the art.

The magnetic attachment array of portable exhibit display 10 is useful for the removable securement of one or more accessories 60. As illustrated in FIGS. 3A-3D, an example accessory 60 includes a rear surface 62 with one or more attachment points 64. To magnetically engage with the magnetic attachment array of Frame 12, accessory 60 may include one or more attachment points 64 in the form of a metallic plate and/or a second magnet 66 adapted to be attracted to first magnets 40 or magnetic fittings 22 of the magnetic attachment array. Accordingly, a polarity of second magnet 66 attracts first magnets 40, and vice versa, so that accessory 60 may be removably magnetically securable to portable exhibit display 10. In some embodiments, second magnets 66 are rare earth magnets available from Applied Magnets under the trade name Neodymium magnets. Attachment points 64, including second magnets 66, may be secured to accessory 60 in any conventional fashion so that the magnetic attraction between attachment point 64 and first magnets 40 retain accessory 60 at the portable exhibit display 10.

As shown in FIG. 1, accessories 60 may be removably magnetically securable to the display frame with the fabric covering 30 in proximity or sandwiched between the framework and the accessory. Those of ordinary skill in the art will recognize that, although the fabric may not exhibit magnetic properties, the first or second magnets 40, 66 have sufficient magnetization to retain the accessory against the framework with the fabric covering 30 operably disposed between the first and second magnets 40, 66 and/or between first magnet 40 and attachment point 64 of accessory 60. Such an arrangement permits the magnetic securement of accessory 60 with portable exhibit display 10 at fabric covering 30, and particularly in proximity to respective magnetic attachment regions 42. The magnetic securement capability facilitates rapid and simple attachment and detachment of various accessories. The attractive force of at least first magnets 40 to respective attachment points 64 provide a "self-locating" function, in which accessory 60 is drawn by magnetic force to an appropriate mounting position wherein the respective attachment points 64 are in proximity to magnetic attachment regions 42 on frame 12. Such a self-locating function operates to correctly position and horizontally level the accessories 60. By way of example, the magnetic attachment regions 42 are provided in predetermined locations of frame 12 at specific spacings and locations to direct a desired magnetic securement of accessories 60.

It is contemplated that a variety of accessories may be utilized in the portable exhibit display of the present invention. Examples include shelves, graphical apparatus, pegboards, and the like. Applicant further contemplates that side walls (not shown) may be magnetically secured to frame 12 as an accessory 60, with or without the covering 30 sandwiched between the accessory and framework. For example, a flange or end portion of a side wall may be provided with one or more attachment points 64 for magnetic interaction with magnetic attachment regions 42 of end upright members 14*a* of frame 12. In such a manner, multiple walls may be added as desired without the need for separate mechanical fasteners or apparatus.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A portable exhibit display, comprising:

a frame having a plurality of interconnectable frame members each having a tubular side wall defining a chamber, said frame members including an array of receptacles in said tubular side walls opening to said chamber;

a fabric covering for tensioned securement to said frame;

a plurality of fittings secured in respective said receptacles, said fittings having first and second ends along a fitting axis, and including a cavity that opens to said first end, wherein said fittings are substantially contained at a respective chamber;

a plurality of first magnets, each secured in the cavity of the respective said fitting to be substantially coextensive with said first end, said plurality of first magnets defining magnetic attachment regions of a magnetic attachment array; and an accessory having a rear surface including an attachment point with at least one of a metallic plate and a second magnet, a polarity of said second magnet attracting said first magnets, said accessory being removably magnetically securable to said fabric covering in proximity to a respective said magnetic attachment region.

2. The portable exhibit display as in claim 1 wherein said accessory includes a plurality of attachment points comprising said second magnets.

3. The portable exhibit display as in claim 2 wherein said fabric covering is operably disposed between said first and second magnets.

4. The portable exhibit display as in claim 1 wherein said accessory is selected from the group consisting of a shelf, a graphical apparatus, a peg board, and a side wall.

5. The portable exhibit display as in claim 1 wherein said first magnets are substantially contained within respective said chambers.

6. A portable exhibit display, comprising:

a framework having a base and a plurality of interconnected tubular frame members that form said framework; at least two of said tubular frame members having a plurality of receptacles formed in said tubular frame members; said receptacles having first magnetized fittings contained within the receptacles such that an outer surface of the magnetized fittings aligns flush with an outer side of said tubular frame members; said magnetized fittings defining magnetic attachment regions along said framework;

a covering secured with tension to said framework;

a three dimensional accessory having attachment points consisting of at least one of a metallic plate and second magnetized fittings, wherein said attachment points are arranged on said accessory to align with said attachment regions of said framework;

said first and second magnetized fittings having a sufficient magnetization to couple and retain said accessory to said framework with the covering sandwiched between the accessory and framework.

7. The portable exhibit display as in claim 6, wherein said accessory is selected from the group consisting of a shelf, a graphical apparatus, a peg board, and a side wall.

8. The portable exhibit display as in claim 6 wherein said first magnetized fittings includes a removable magnet contained within the first magnetized fitting.

9. A portable exhibit display, comprising:

a framework having a base and a plurality of interconnected tubular frame members that form said framework; at least two of said tubular frame members having a plurality of receptacles formed in said tubular frame members; said receptacles having first magnetized fittings contained within the receptacles such that an outer surface of the magnetized fittings aligns flush with an outer side of said tubular frame members; said magnetized fittings defining magnetic attachment regions along said framework; said magnetized fitting being secured within the receptacles of said tubular frame members with a screw attachment;

a covering secured with tension to said framework;

a three dimensional accessory having attachment points consisting of at least one of a metallic plate and second magnetized fittings, wherein said attachment points are arranged on said accessory to align with said attachment regions of said framework;

said first and second magnetized fittings having a sufficient magnetization to couple and retain said accessory to said framework with the covering sandwiched between the accessory and framework.

10. The portable exhibit display as in claim 9, wherein said accessory is selected from the group consisting of a shelf, a graphical apparatus, a peg board, and a side wall.

11. The portable exhibit display as in claim 9 wherein said first magnetized fittings includes a removable magnet contained within the first magnetized fitting.

* * * * *